US006663211B2

(12) United States Patent
Aratsu

(10) Patent No.: US 6,663,211 B2
(45) Date of Patent: Dec. 16, 2003

(54) PRINTING DEVICE AND ROLL PAPER

(76) Inventor: Shuichi Aratsu, c/o Alps Electric Co., Ltd., 1-7, Yukigayaotsukacho, Ota-ku, Tokyo 145 (JP)

( * ) Notice: Subject to any disclaimer, the term of this patent is extended or adjusted under 35 U.S.C. 154(b) by 0 days.

(21) Appl. No.: 09/820,280

(22) Filed: Mar. 28, 2001

(65) Prior Publication Data

US 2002/0033853 A1 Mar. 21, 2002

Related U.S. Application Data

(63) Continuation of application No. 09/298,877, filed on Apr. 26, 1999, now abandoned.

(51) Int. Cl.[7] ..... B41J 15/00; B41J 29/38
(52) U.S. Cl. ..... 347/16; 347/101
(58) Field of Search ..... 347/16, 101, 157, 347/215, 217; 242/68.4; 226/11; 400/208

(56) References Cited

U.S. PATENT DOCUMENTS

| | | | | |
|---|---|---|---|---|
| 3,696,981 A | | 10/1972 | Levy | 226/11 |
| 3,866,850 A | | 2/1975 | More | 242/68.4 |
| 4,087,825 A | | 5/1978 | Chen et al. | 346/75 |
| 4,380,771 A | | 4/1983 | Takatori | 347/43 |
| 4,617,580 A | | 10/1986 | Miyakawa | 346/136 |
| 4,727,437 A | | 2/1988 | Mizoguchi | 358/304 |
| 4,841,653 A | | 6/1989 | Negley | 40/26 |
| 4,847,638 A | | 7/1989 | Moriyama | 227/149 |
| 5,056,042 A | | 10/1991 | Lieb | 364/519 |
| 5,250,989 A | | 10/1993 | Morita et al. | 355/210 |
| 5,290,114 A | | 3/1994 | Asami et al. | 400/208 |
| 5,351,071 A | | 9/1994 | Matsuda et al. | 346/136 |
| 5,352,049 A | | 10/1994 | Shiraishi et al. | 400/208 |
| 5,519,428 A | * | 5/1996 | Van Peteghem | 347/215 |

FOREIGN PATENT DOCUMENTS

| | | |
|---|---|---|
| EP | 0 401 036 | 12/1990 |
| EP | 0 646 460 A1 | 4/1995 |
| EP | 0 661 162 | 7/1995 |
| JP | 58022178 | 2/1983 |
| JP | 60048367 | 3/1985 |
| JP | 63237970 | 10/1988 |
| JP | 3-238257 | 3/1991 |
| JP | 03146356 | 6/1991 |
| JP | 3-180349 | 8/1991 |
| JP | 04045959 | 2/1992 |
| JP | 05147295 | 6/1993 |
| JP | 05330122 | 12/1993 |
| JP | 06031967 | 2/1994 |
| JP | 06226963 | 8/1994 |
| JP | 6-226963 | 8/1994 |

* cited by examiner

*Primary Examiner*—Anh T.N. Vo
(74) *Attorney, Agent, or Firm*—Charles N. Quinn

(57) ABSTRACT

To provide a printing device capable of automatically detecting the type of a roll paper, the printing device comprises a movable flange abutting member adapted to be pressed against an outer periphery of the flange of the holder of the paper roll supported in a paper roll support mechanism, the flange having an outer diameter set in correspondence with the type of said roll paper; a detection unit of paper type adapted to be subjected to positioning by the outer periphery of the flange for detecting the type of the roll paper; a detection unit of paper presence/absence provided at a printing portion in facing relation to said platen to detect the presence of said roll paper without contact thereto; a detection unit for detecting the leading end of the roll paper arranged between the printing portion and a cutting portion to be subjected to a printing operation; and controller for controlling actions of the relevant portions on the basis of the detection result of each detection unit.

19 Claims, 5 Drawing Sheets

(A)

(B)

(A)

(B)

PRINTING DEVICE AND ROLL PAPER

This application is a continuation application Ser. No. 09/298,877 filed Apr. 26, 1999 abandoned.

BACKGROUND OF THE INVENTION

This invention relates to a printing device like an ink jet printer for ejecting ink onto roll paper for printing. More specifically, this invention relates to a printing device for detecting type of roll paper loaded, the presence or absence of the roll paper, the leading end of the roll paper, and a preferable roll paper to be used in a printing device.

PRIOR ART

Nowadays, it has become possible for everybody to easily perform image printings thanks to the progress of computers and printing devices. Among the characteristic examples of printing devices is known an electrophotographic copier which causes a toner to adhere onto an electrostatic potential image formed on the paper roll and transcript the toner image onto the printing paper, a printing device which is called an ink jet printer of the aforementioned ink jet type or a printing device which is called a thermal transfer printer of a thermal transfer type which is adapted to melt the ink on the ink ribbon by means of a heated thermal head or cause the heat sensitive paper to be colored.

While color printing in general is required to have a good color tone quality and wheatherproofness, a wide application of printing media varing from paper, cloth, film or the like is seen and in order to maintain a printing quality in an excellent condition, the printing conditions are in general subjected to review on the basis of the type or property of a printing medium.

While it is possible to discriminate types of paper used through its factors such as surface roughness, light transparency and rigidity, but it is not practical to mount detection mechanism for that purpose upon printing device, because one detection device is necessary for anything of said paper factors, thus increasing considerably the cost of printing device. When detecting type of paper using the factor of light transparency, only three states of paper, i.e. transparent, translucent and opaque, which limits adaptation to more and more various types of paper. As described above, direct detection of paper type has been difficult in technical and economical view points.

In general, users of printing device have input the type of paper used into printing device by any means. One of these means has been setting of the type of paper on the operating panel of printing device by user. More recently, the information about type of paper to be used is often transferred into printing device from personal computer together with printing data. In the last case, user selects his desired type of paper from Paper Menu printed on a software called Printer Driver containing types of paper such as common paper, coat paper, film for a overhead projector (OHP), back print film, burnished paper and the like.

In addition, it is essential to set printing paper sheets neatly on the printing device. If not, it is not only impossible to maintain the printing quality but also likely to lead to the trouble in which the printing head can rub the printing face of the paper sheet or perform the printing action without the printing paper sheet being fed onto the platen with the result that the paper sheet is stained or the printing head and the platen are damaged to lead to the trouble of the printing device.

Therefore, it is required in general to refrain from performing a printing operation when the printing paper is not set properly or has run out.

In the case of a printing device which uses a long roll paper which necessitates a paper cut mechanism for cutting off the roll paper, it is often observed that an immediate start of the subsequent printing operation after the paper cutting operation to create an extra margin on the leading end of the paper sheet, which must be thrown away. This is not only a waste of paper but also another cutting operation must be done after the subsequent cutting of the roll paper, causing a duplication of work.

In such conventional method of using the roll paper, the roll paper payed out from the paper roll is fed in an opposite direction to the regular feed direction to reduce a margin space in the leading end of the paper as much as possible.

On the other hand, while there are several cases where one can easily discriminate paper used by means of appearance thereof and touch feeling thereon, there are so many papers which have resembling appearance and feeling. Therefore, users erroneously set different types of papers such as common paper and coat paper, both of which have same color at a glance, though they have quite different colors when reviewed carefully.

In case where the printing device is constructed such that it performs the printing operation by switching the printing conditions in accordance with the type of printing paper to be used, printing can be done on a condition other than suited for the paper if the operator makes an erroneous setting concerning the type of printing paper with the result that the printing quality desired by the operator cannot be obtained. Further, if the operator uses a printing device of the ink jet type which for example can perform a printing operation in not prescribed ink quantity for some type of printing paper. In this way, if setting is done on the basis of a wrong type of paper, extra ink used can adhere to some portions of the printing device to such an extent as thus staining the printing device or the printing paper.

Detecting devices used in a conventional printing device are known as a lever type, an optical type, etc.

In said lever type printing paper detect mechanism, the lever position varies depending upon the presence or absence of the printing paper and said varied lever position is detected as ON/Off signals of the switch. On the other hand, an optical type paper detection mechanism includes a reflection type in which a light irradiated by the light emitting portion onto the paper to be reflected thereby is detected by the light receiving portion and a transmission type in which a light transmitted is detected by a light receiving portion positioned opposite the light emitting portion.

In said optical paper detection mechanism of reflection type permits the variation of the intensity of reflection of the light irradiated by the light emitting portion on the basis of the presence or absence of the printing paper to be converted into the variation of the electrical output for detection. On the other hand, the optical paper detection mechanism of transmission type converts into the variation of electrical output the variation of intensity of light determined depending on whether or not to interrupt the light irradiated by the light emitting portion on the basis of the presence or absence of the printing paper.

In the conventional printing paper detect mechanism, it is possible to detect the presence or absence of the printing paper regardless of the light transmitting property whether transparent or opaque if the mechanism is of a lever type. However, such mechanism has a problem that it is necessary to bring the lever in contact with the platen by way of the printing paper in order to detect the presence or absence of the printing paper at the printing portion, causing the lever to contact the platen directly if there is no printing paper thereat with the result that the platen can be damaged. Therefore, an optical paper detect mechanism of reflection type is used in general as a paper detection mechanism.

Such optical paper detection mechanism of reflection type has another problem that it is impossible as is to detect the presence or absence of the printing paper if the paper is a light transmitting transparent sheet such as OHP paper. Then, a light reflecting opaque portion is formed at an end portion (said end portion taken in a direction perpendicular to the paper feed) of the transparent sheet so that said opaque portion reflects the light to be detected. However, such method also has a problem that the opaque portion at the end of the printing paper makes it impossible to effectively use the entire surface of the printing paper and makes the opaque portion too conspicuous to prevent the printed image from viewed easily when projected by an over head projector.

Further, excessive rewinding of the roll paper in the user's attempt at saving the paper or any possible misalignment of the leading end of the roll paper upstream of the correct position of printing portion can cause a printing action to be performed against the platen or cause a clogging of paper as a result of excessive rearward feed.

SUMMARY OF THE INVENTION

In view of the above points, it is the object of the present invention to provide a printing device which is capable of automatically detecting the type of the roll paper.

It is another object of the present invention to provide a printing device which is capable of effectively detecting the presence and absence of the roll paper formed of a light transmitting transparent sheet by means of an optical printing paper detect mechanism and a roll paper which is detected in a favorable condition by the optical printing paper detection mechanism.

It is a further object of the present invention to provide a printing device which is capable of automatically detecting whether or not the leading end of the roll paper fed for the printing operation is positioned properly when the roll paper has been rewound in order to prevent an extra margin from being formed.

In order to achieve the aforementioned object, a printing device according to claim 1 is characterized by a holder engaging member which is movable and can be applied onto peripheral surface of the flange of said holders of said paper roll held by said paper roll holding mechanism, by a paper type detection unit for detecting type of said roll paper according to the position of said flange engaging correspondingly to outer diameter of said flange representing type of said roll paper used, by a paper presence/absence detection unit for detecting the presence or absence of said roll paper without contact therewith is located in said printing portion so as to oppose to said platen, by a paper leading end detection unit for detecting the leading end of said roll paper is located between said printing portion and a cutting portion, and control means for controlling actions of the relevant portions on the basis of the detection result of each detection unit.

In such a construction, said paper type detection unit can automatically detect type of paper only by amounting a flange, outer diameter of which is adapted to type of roll paper, said paper presence/absence detection unit can automatically detect the presence or absence of said roll paper without contact therewith, said paper leading end detection unit can automatically detect whether the paper leading end of said roll paper is in a appropriate position or not, and control means can control appropriate actions of the relevant portions on the basis of the detection result of each detection unit.

The printing device according to claim 2 is characterized in that the detecting unit of paper presence/absence is composed of a photosensor while the control means is constructed to determine the paper type by reversing information from the photo sensor on the basis of a result whether or not light transmission.

By adopting the aforementioned construction, the it is possible to automatically detect the presence/absence of the roll paper by means of the photosensor notwithstanding the result as to whether or not the roll paper is of light transmitting nature.

The roll paper according to claim 3 is characterized by being formed of a light transmitting transparent sheet and having a light reflector at the trailing end thereof.

By adopting the aforementioned construction, it is possible to effectively use the entire surface of the roll paper if said roll paper is formed of a light transmitting transparent sheet and said light reflector of the roll sheet is capable of automatically detecting the presence/absence of the paper.

DETAILED DESCRIPTION OF THE INVENTION

Figure 1:
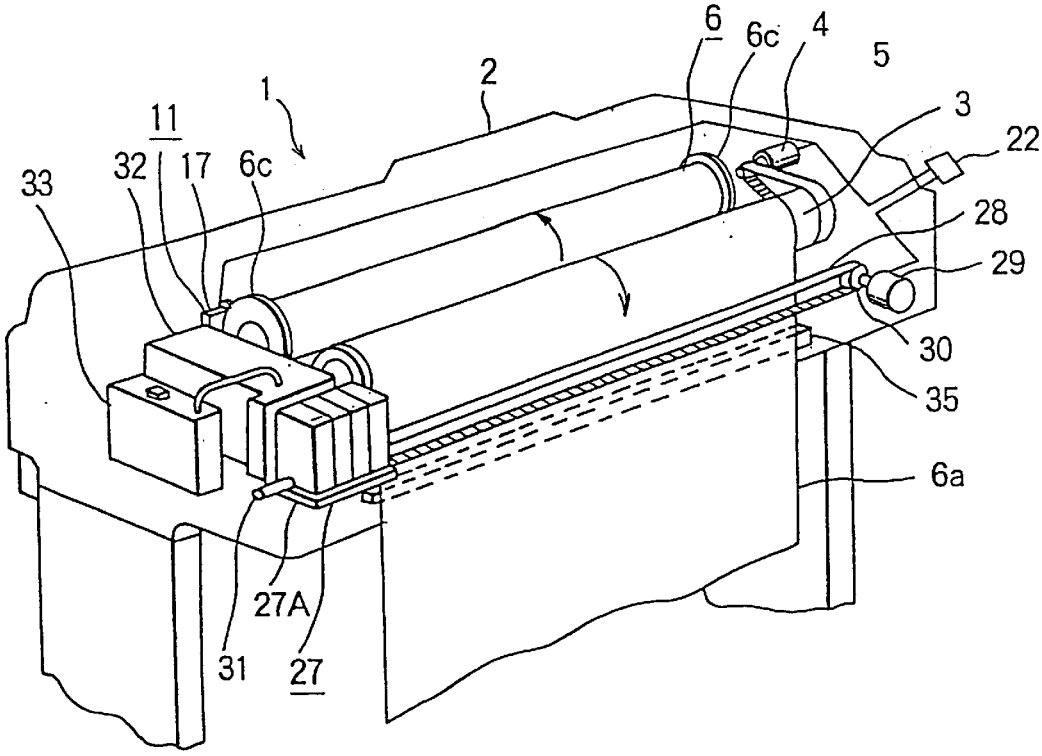
FIG. 1 is a perspective view showing an embodiment of the printing device according to the invention.
Figure 2:
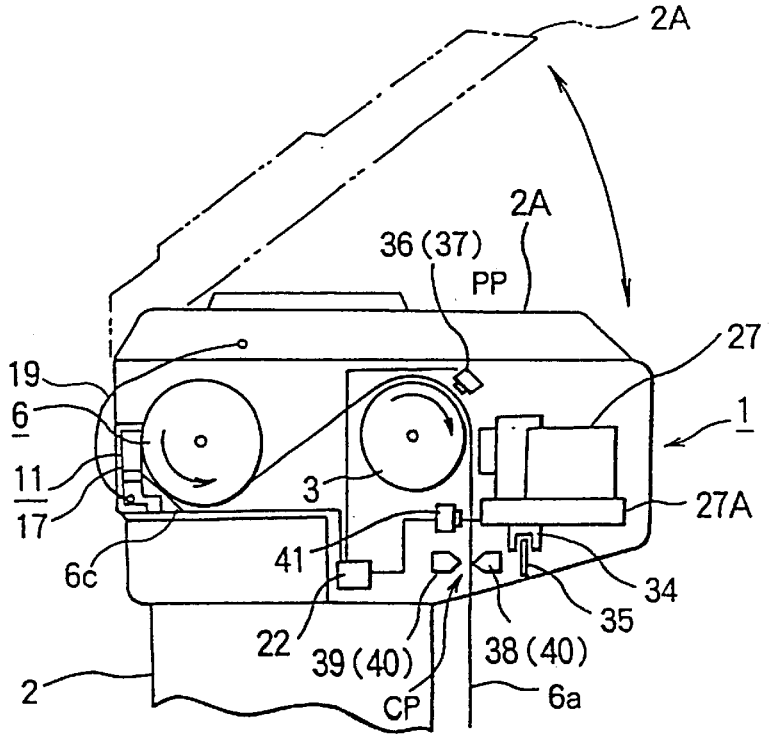
FIG. 2 is a partial side view of the printing device shown in FIG. 1.

An embodiment of printing device 1 according to the present invention as shown in FIG. 1 and FIG. 2, has a housing 2, in which a cylindrical platen 3 is rotatably mounted with its axis extending in horizontal direction. Said surface of platen 3 can absorb light and is controlled not to reflect light such as a coarse surface to assure diffused reflection or blacked surface to absorb light. A driven pulley (not-shown) is supported by one end to said platen 3, a belt 5 driven by a first reversible motor 4 being wound on said driven pulley. Accordingly, said platen 3 can be driven by driving force of said first motor 4 in the normal transporting direction or in the reverse direction.

A paper roll 6 having an axis parallel to said platen 3 is mounted on the rear side of said platen 3 in said housing 2. A roll paper 6*a* to be explained later, being wound on the peripheral surface of said paper roll 6. When said paper roll 6 is rotated in counter-clockwise direction in FIG. 2, roll paper 6*a* to be used is released out of paper roll 6 to be wound on the upper side of said platen 3.

Figure 3:
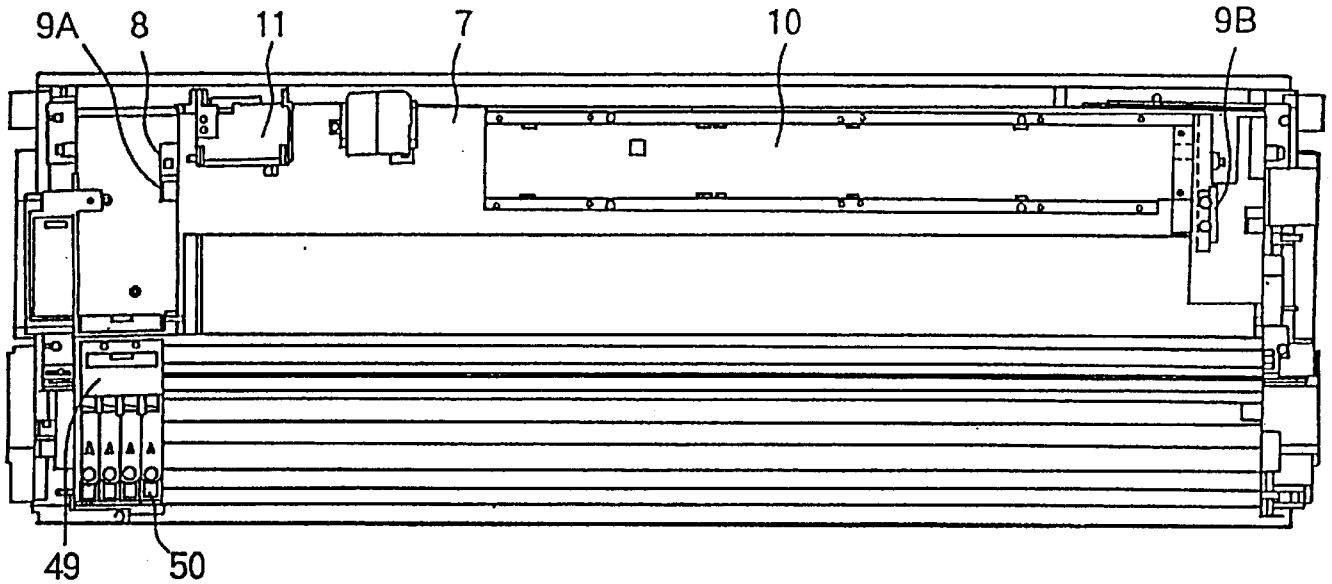
FIG. 3 is a plan view showing the roll holding mechanism shown in FIG. 1.

Said paper roll 6 is supported as shown in FIG. 3 on a pair of holding portions 9A and 9B of paper roll holding mechanism over a base section 7 of the printing device 1 with a spacing therebetween in a longitudinal direction. Of the two members, the holding portion 9B is detachably loaded at a plurality of positions on a holding portion supporting plate 10 to fit the width of the roll paper 6*a*. Close to said holding portion 9A, detection unit 11 of paper type for detecting the type of the roll paper 6*a* used as a printing paper.

Figure 4:
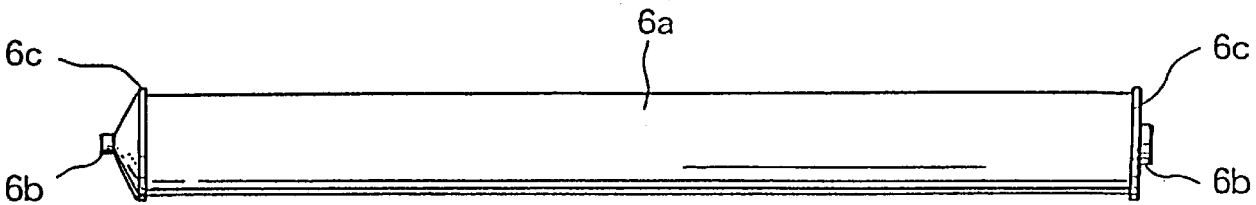
FIG. 4 is a front view of the paper roll used in the embodiments.

As shown in FIG. 4, said paper roll 6 comprises said roll paper 6*a* wound on a paper tube (not-shown), said paper tube having paper tube holders 6*b*, 6*b* mounted on its both ends, and these paper tube holders being held respectively by said roll holders 9A, 9B. Said each paper tube holder 6*b*, 6*b* has round flange portion 6*c* having a diameter larger than that of roll paper 6*a*. According to the invention, the diameter of said flange portions 6*c* has different size according to the type of roll paper 6*a* wound on said paper tube, i.e. common paper, coat paper, film for OHP, back print film, burnished film and the like. Accordingly, one can identify the paper type according to the diameter of flanges 6*c* used.

Figure 5:
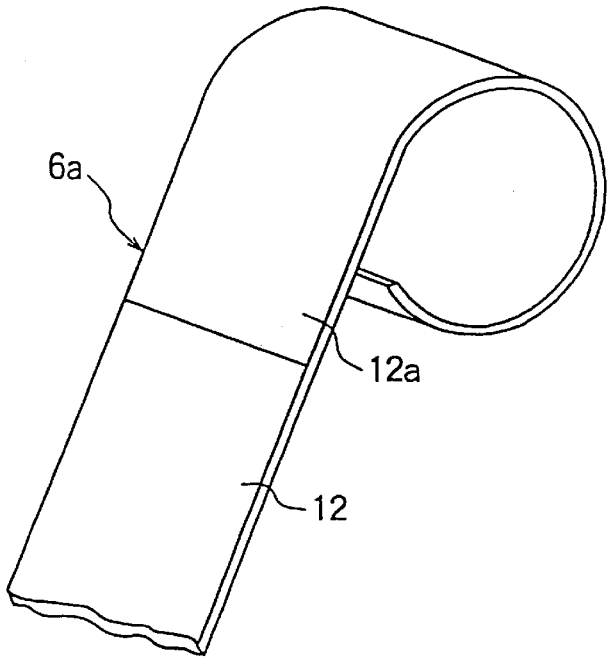
FIG. 5 is perspective views showing the paper roll used in the embodiments.
Figure 5:
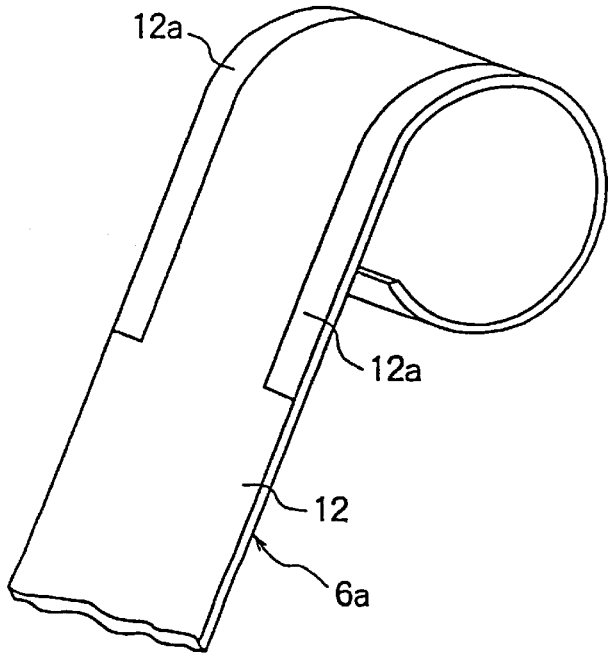

Further, in this embodiment, if the roll paper 6*a* is formed of a light transmitting transparent sheet 12 such as OHP paper, a light reflecting portion 12*a* is provided only at a trailing end of the light transmitting transparent sheet 12 as shown in FIG. 5(A). In this connection, the light reflecting portion 12*a* may be provided at opposite sides perpendicular to the longitudinal direction as shown in FIG. 5(B). So long as provided at the trailing end thereof, the structure is not limited to this embodiment.

Figure 6:
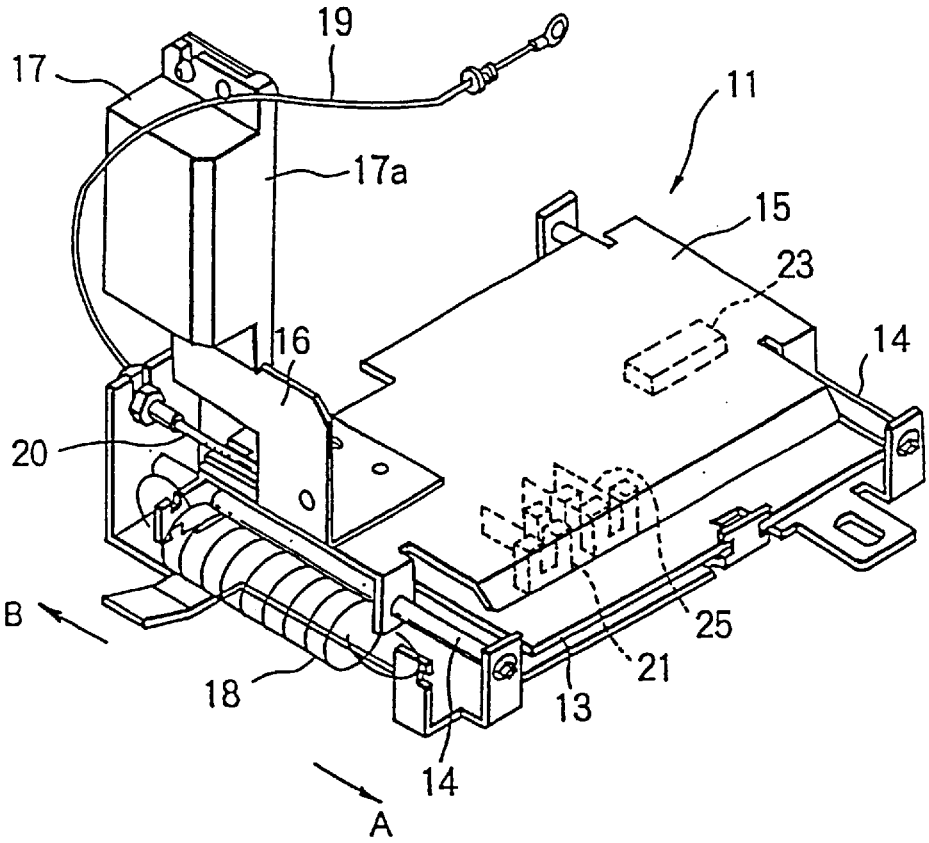
FIG. 6(A) is an enlarged perspective view of the paper type detection unit and FIG. 6(B) is a perspective view of the essential portion of FIG. 6(A)
Figure 6:
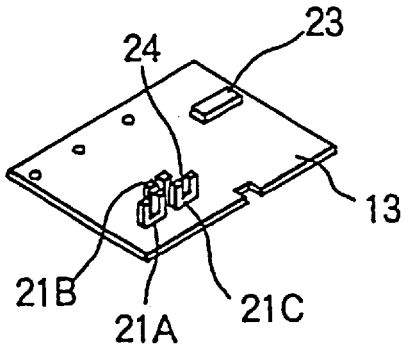

As shown in FIG. 6, said detection unit of paper type 11 for outputting detection signals for detecting type of said roll paper 6*a* has abase plate 13 located adjacent to one of said roll holders 9A. Said base plate 13 supports above it a pair of parallel guide rods 14, 14 which are parallel to each other and extend in horizontal direction so as to vertically cross the axis of said paper roll 6. A sliding table 15 is mounted on said guide rods 14, 14 so as to shift along the extending direction of said rods 14. A bracket 16 extends upwardly on the one end of said sliding table 15, and said bracket 16 supports thereon a flange abutting block member 17 having its one side surface 17*a* used as a flange abutting surface. A coil spring 18 is provided between said base plate 13 and said sliding table 15 so as to urges said sliding table 15 in the direction A shown in FIG. 6(A) for pressing said flange abutting member 17 onto said flange 6*c* of said paper roll 6.

One end of a wire 19 as a manipulating member is connected to said bracket 16. On the other hand, a hollow tube 20 is fixed on an edge portion of said base plate 13 so as to extend from the fixing point of said wire 19 on said bracket 16 in a reverse direction B to the urging direction A of said coil spring 18. Said wire 19 passes through said tube 20 and extends outside of said base plate 13, the other end of said wire 19 being fixed onto said cover 2A (FIG. 2). Consequently, when opening said cover 2A, said sliding table 15 is shifted by said wire 19 in the direction B against the urging force of said coil spring 18. Accordingly, when exchanging paper roll 6, said flange abutting member 17 as an example of roll holder abutting member is retracted into a retracted position. Further, when said cover 2A is closed, said wire 19 is relaxed and said sliding table 15 is pulled in the direction A due to the urging force of said coil spring 18.

Three photosensors 21A, 21B, 21C and an output connector 23 for outputting signals from respective photosensors 21 to said controller 22 (FIG. 7) are located on said base plate 13. Said respective photosensors 21 have respectively a U-form, and three state setting sheets 25 having each plate form to be inserted into the hollow portions of corresponding photosensors 21 are supported on the rear side surface of said sliding table 15 so as to engage into respective photosensors 21. Each state setting sheet 25 is a shielding plate for shielding light from light emitting portion of each photosensor so as not to reach light receiving portion thereof, while said state setting sheet 25 has slits (not-shown) allowing light from light emitting portion thereof to reach light receiving portion thereof.

Each photosensor 21 has a construction such that it outputs signal ON when light from light emitting portion reaches light receiving portion, while it outputs signal OFF when light from light emitting portion does not reach light receiving portion. As a result, the position of sliding table 15 with respect to said base plate 13 is changed correspondingly to diameter of said flange 6*c* at the end of paper roll 6. Thus, each photosensor 21A, 21B, 21C outputs ON signal or OFF signal to said CPU board 26 (FIG. 7) according to the position of said slits of corresponding state setting sheet 25. On the other hand, said CPU of said CPU board 26 of the control means 22 can thus detect the type of paper (roll paper 6*a*) according to the flange diameter obtained by combination of ON or OFF signals issued from respective three photosensors 21 as shown in the following Table 1. The types of paper thus detected are output to said CPU board 26 and are displayed on a displaying panel (not-shown) of the device 1.

TABLE 1

| Paper Type | Flange Diameter (mm) | Sensor A | Sensor B | Sensor C |
|---|---|---|---|---|
| No Paper | 0 | ON | ON | ON |
| 1 | 48–52 | OFF | ON | OFF |
| 2 | 58–62 | OFF | OFF | ON |
| 3 | 70–74 | ON | OFF | ON |
| 4 | 80–84 | OFF | ON | ON |
| 5 | 88–92 | ON | ON | OFF |
| 6 | 98–102 | ON | OFF | OFF |

Sensors A, B and C shown in this Table 1 designated respectively said photosensors 21A, 21B and 21C.

Said CPU board 26 can carry out image processing and driving of ink jet heads (not-shown) in Table 2 correspondingly to detected type of paper.

TABLE 2

| Paper Type | Image Processing | Paper Feeding | Ink Jet Head |
|---|---|---|---|
| 1 | Standard | Standard | Standard |
| 2 | Standard | Standard | Standard |
| 3 | Standard | Standard | Standard |
| 4 | Dedicated | Standard | Dedicated (Less Ink Ejecting) |
| 5 | Private | Dedicated (Double Printing) | Standard |
| 6 | Standard | Standard | Dedicated (Scan Speed Accelerated) |

A paper hold (not-shown) to hold roll paper 6*a* to be used is released out of paper roll 6 to be kept on the peripheral surface of platen 3 is mounted in the space opposing to said platen 3 in said housing 2. Further, an ink jet unit 27 reciprocating along said platen 3 in a direction parallel to the axis thereof is provided in the space opposing to said platen 3 in said housing 2. A carriage 27A of said ink jet unit 27 has thereon a plurality of ink jet heads (not-shown) which are directed against said platen 3. The position where said ink jet heads discharge ink toward the roll paper 6*a* held against the outer periphery of the platen 3 is designated as a printing portion PP (FIG. 2) to do the printing against the roll paper 6*a*.

A driving belt 28 is connected to said ink jet unit 27, and said driving belt 28 is wound about a driving pulley 30 which is driven by a second motor 29 of reversible type. Accordingly, when driving said second motor 29, said ink jet unit 27 is reciprocated along said platen 3 under the guidance of a guide shaft 31 located in parallel to said platen 3. A pump unit 32 for covering the nozzles of restrictive ink jet heads of said ink jet unit 27 for the purpose of recovering operation thereof is located on one side of the other end portion of said platen 3, and an exhaust liquid tank 33 is provided adjacent to said pump unit 32.

Photointerrupters 34 of transmission type are located with a distance therebetween in the front and back direction of said carriage 27A on the bottom side of said carriage 27A of said ink jet unit 27, and a linear encoder 35 comprising a thin plate having therein a number of small holes corresponding to printing resolution is located along the whole range of shifting ink jet unit 27.

A detection unit 36 for detecting roll paper 6*a* on said platen 3 is located on the upstream side of said ink jet unit 27 in the normal conveying direction of said roll paper 6*a* so as to oppose said platen 3. Said roll paper presence/absence detection unit 36 has photosensors 37 to emit a light from the light emitting portion toward the outer periphery of the platen 3. The thus emitted light is reflected by the roll paper 6*a* positioned on the platen 3 such that the intensity of the reflected light is converted into an electrical signal by the light receiving portion to be sent to the control means 22 which will be explained later.

Cutting unit 40 consisting of long sized fixed blade 38 and movable blade 39 for cutting printed roll paper 6*a* is located below said platen 3 and ink jet unit 27.

Said paper detection unit 41 for detecting roll paper 6*a* is located between said printing portion PP and said cutting portion CP. The detection unit 41 of the paper leading end is for determining whether or not the reverse feed amount of the roll paper 6*a* is adequate at such a time as the cut roll paper 6*a* to be subjected to printing is fed backwardly of the regular feed direction. When a lever switch not shown detects the leading end (cut end) of the roll paper 6*a*, a detect signal is emitted to the control means 22 which will be explained later. Then, said control means 22 stops driving the first motor 4 which is feeding the roll paper 6*a* backwardly.

Each driving portion such as said both paper detection units 11, 36, 41 and said both motors 4, 29 and ink jet unit 27 is respectively connected to a control means 22, so that when signals about roll paper 6*a* from said paper detection units 11, 36, 41 are input into said control means 22, this control means 22 controls said respective motor 4, 29 and ink jet unit 27 correspondingly to the input signals.

As shown further in FIG. 2, the upper opening (not-shown) of said housing 2 is covered by a closing cover 2A.

Figure 7:
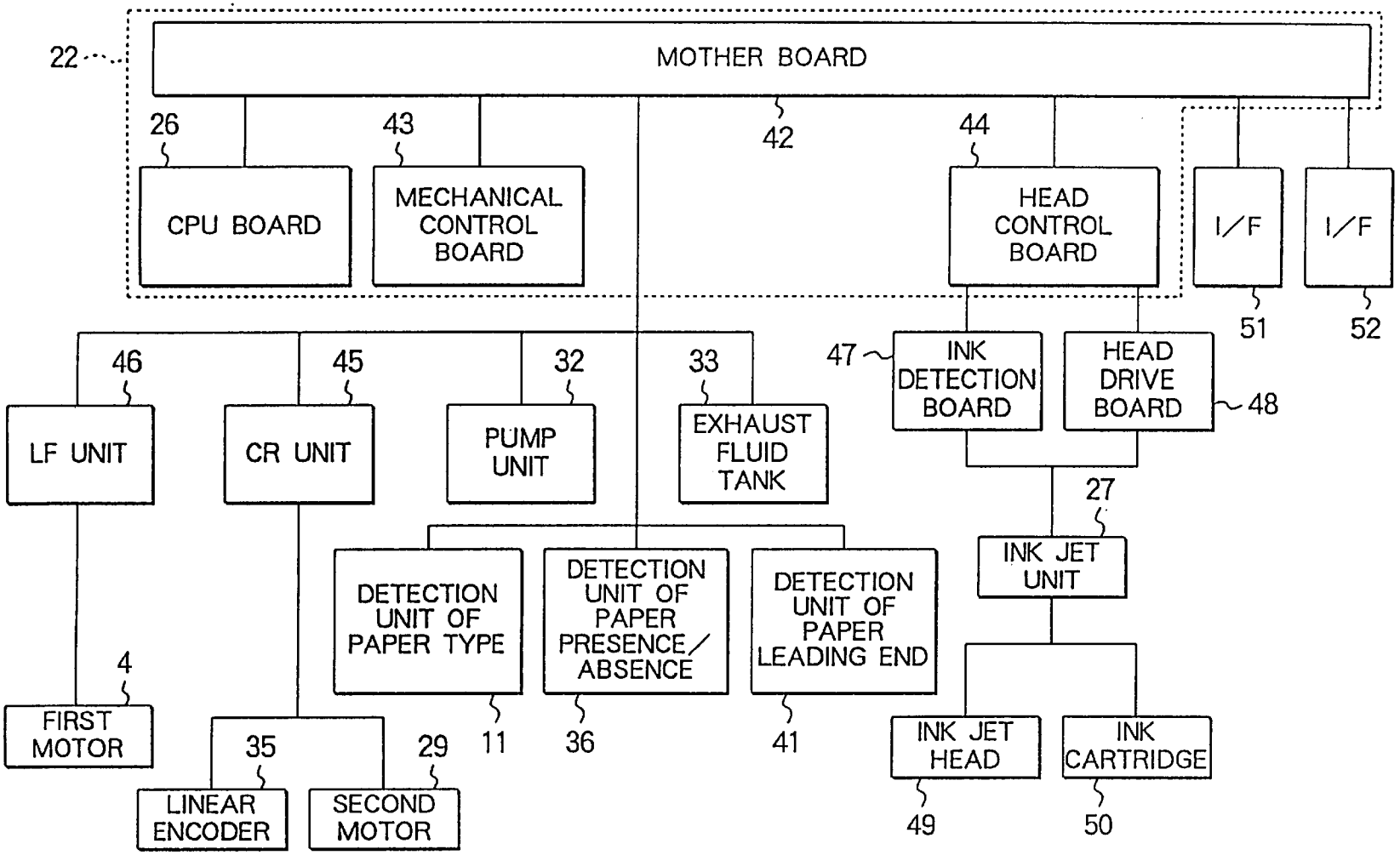
FIG. 7 is a control block diagram including the control means of the printing device shown in FIG. 1.

FIG. 7 shows a control block diagram of printing device including said control means 22.

As shown in FIG. 7, said control means 22 consists of a mother board 42 having a control panel (not-shown); a CPU board 26, a mechanical control board 43 and a head control board 44 connected to each other via said mother board 42.

Said mother board 42 is connected to a paper detection unit 11 for detecting the type of roll paper 6*a* used, a paper presence/absence detection unit 36 for detecting the presence or absence of said roll paper, a paper leading end detection unit 41 for detecting the leading end of said roll paper, said pump unit 32; said exhaust liquid tank 33; a CR unit 45 for driving said second motor 29 shifting said ink jet unit 27; a LF unit 46 for driving said first motor 4 conveying said roll paper 6*a*.

Said CPU board 26 has built-in CPU, ROM, RAM and the like, among which ROM has programs for operation and graphic processing, and carrying out printing based on corresponding detection result, such as type of paper, presence or absence of paper, leading end of paper by detecting signals provided by each detection unit 11, 36 and 41.

Said mechanical control board 43 includes drivers (not-shown) for driving said detection units 11,36 and 41, pump unit 32, CR unit 45 and LF unit 46. Further, said mechanical control board 43 can transfer signals to said CPU of said CPU board 26.

Said head control board 44 has ink detection board 47 and head drive board 48, and transfers a detection signal of residual ink quantity detected by said ink detection board 47 located on said ink jet unit 27 to said CPU of said CPU board 26, and, in said head drive board 48, said head control board 44 also transfers logical signals based on information from said CPU for driving said ink jet unit 27. Based on said logical signals, said head drive board 48 generates driving signals for driving respective ink jet head 49 and respective ink cartridge 50.

Further, in said CR unit 45, said linear encoder 35 is connected in parallel to said second motor 29, said linear encoder 35 outputting to said CPU of said CPU board 26 signals correspondingly to rotational sped of said second motor 29 for equalizing the shifting speed of said ink jet unit 27.

Further, said mother board 42 is provided with interface unit 51, 52 for connecting this printing device 1 to personal computer and the like.

Further, the program stored in said CPU board 26 determines the presence of the paper upon detection of an intense reflection and outputting an electrical signal HIGH by the photosensor 37 of the detection unit 36 of paper presence/absence when the paper (roll paper 6*a*) detected by the detection unit 11 of paper type is opaque. On the other hand, if the paper detected by the detection unit 11 of the paper type is transparent, most of the light emitted by the light sensor 36 of the detection unit 36 of the paper presence/absence permeates the paper to be absorbed by the surface of the platen such that the photosensor 37 of the detection unit 36 of the paper presence/absence will not detect the reflection and emits an electrical signal LOW to determine the presence of the paper.

In other words, the control means 22 is constructed to perform a reverse determination concerning the information from the photosensor 37 of the detection unit 36 of paper presence/absence based on the result obtained by the detection unit 11 of the paper type as to whether the paper 6*a* is of light transmitting nature or not.

Next, the operation flow of said printing device 1 will be explained hereinafter.

First, cover 2A is opened for mounting a paper roll 6 including a desired type of roll paper 6*a* onto roll holding mechanism 8. Wire 19 connected to this cover 2A is thus pulled in the direction B against the urging force of coil spring 18, so that sliding table 15 connected to this wire 19 is also pulled in the same direction B and flange abutting member 17 is retracted into a retraction place so as not to impede inserting operation of paper roll 6. In this state of mechanism, holders 6*b* having each flange 6*c* of outer diameter adapted to that of roll paper 6*a* mount paper roll 6 on both roll holders 9A, 9B of roll holding mechanism 8.

Then, upon closing of cover 2A, wire 19 is relaxed, sliding table 15 shifts in the direction A under the urging force of coil spring 18, and abutting surface 17*a* of flange abutting member 17 is urged onto peripheral surface of flange 6*c*. Correspondingly to the position of thus stopped sliding table 15, three photosensors 21 are respectively ON state or OFF state, so that type of paper is detected as shown in Table 1. This information is output from output connector 23 to said CPU board 26 which detects type of paper based on Table 1 and can indicate predetermined image processing and head driving corresponding to detected type of paper.

Upon switching printing device power supply into ON, CPU of CPU board 26 initializes respective parts 26, 43, 44, 47, 48 and respective units 27, 32, 45, 46 and respective detection mechanism 11, 36, 41 and then recognizes type of paper used, presence or absence of paper on the printing portion PP, position of leading end of paper, by means of signals from paper detection unit, paper presence/absence detection unit and paper leading end detection unit, respectively. In this situation, the recognition of the paper by means of the photosensor of the detection unit 36 of the paper presence/absence for the control means 22 is constructed to perform a determination by reversing the information from the photosensor 37 of the detection unit 36 of the paper presence/absence on the basis of the result as to whether the paper is light transmitting or not.

In other words, in case where the detection result as to the type of the roll paper 6*a* by means of the detection unit 11 of the paper type is that the paper is an ordinary opaque paper which will not allow a light to permeate therethrough, the photosensor 37 of the detection unit 36 of paper presence/absence detects an intense reflection by the surface of the roll paper 6*a* to emit an electrical signal HIGH for the control means 22 to provide a determination of "paper present" when the roll paper 6*a* is on the platen 3 whereas the light emitted by the photosensor 37 is directly irradiated onto the surface of the platen 3 to be absorbed by its surface such that the photosensor 37 will not detect the reflected light and emits an electrical signal LOW for the control means 22 to provide a determination of "paper absent".

On the other hand, in case where the detection result as the type of the roll paper 6*a* by means of the detection unit 11 of the paper type is that the paper is formed of a transparent sheet 12 of light transmitting paper such as a paper for the over head projector, the photosensor 37 will not detect the reflected light because most of the light irradiated by the photosensor 36 of the detection unit 36 of paper presence/absence permeates the paper directly onto the surface of the platen 3 to be absorbed thereby when the roll paper 6*a* is positioned on the platen 3. In such situation, the photosensor emits an electrical signal LOW such that the control means 22 provides a determination of "paper present". When the trailing end of the roll paper 6*a* is positioned on the platen 3 after the printing has been done on the roll paper 6*a*, the photosensor detects an intense reflection from the light reflecting portion 12*a* formed of a transparent sheet and positioned at the trailing end of the roll paper 6*a* on the platen and outputs an electrical signal HIGH such that the control means 22 provides a determination of "paper absent".

In other words, the control means 22 is constructed to perform a determination by reversing the output (information) from the photosensor 37 based on the result obtained by the detection unit 11 of the paper type as to whether the roll paper 6*a* is of light transmitting nature or not.

In this connection, the roll paper 6*a* is cut off at its trailing end by the paper cutting unit 40 after the printing action to form a separate sheet of paper which is discharged to complete the printing operation. When the printing operation of a sheet of paper is finished, it is needed for performing the next printing action to rewind the roll paper 6*a* by a predetermined distance by the first motor 4 because the distance from the printing portion PP to the cutting portion CP is larger than the margin formed at the leading end of the paper at the time of an ordinary printing action. The amount of reverse feed of the roll paper 6*a* is sufficiently compensated for by feeding the roll paper 6*a* backwardly a constant amount if the leading end of the roll paper 6*a* is always positioned at the cutting portion CP. Actually, however, the position of the leading end of the roll paper 6*a* varies depending on situations so that the amount of reverse feed of the roll paper 6*a* is determined by the result of detection of the leading end of the roll paper 6*a* by means of detection unit 41 of the paper leading end. In other words, the control means 22 controls the amount of reverse feed for the roll paper 6*a* by driving the second motor 29 until the detection unit 41 of the leading end of the paper detects the leading end of the roll paper after the roll paper 6*a* is cut off at its trailing end by the paper cutting mechanism 40 such that position of the leading end of the roll paper 6*a* for the printing action is done at a position suitable for printing.

From the information about ink type stored in a nonvolatile memory in head control board 44, said CPU receives signals for recognizing ink type. By using the data of detected type and type of ink and/or paper, said CPU looks up data table written in ROM of said CPU board 26, thereby to set the procedure of the printing data and to set servo constant to determine the printing speed.

In this way, the printing is done in accordance with the type of ink and paper.

In this embodiment of the invention, since type of paper can be automatically detected upon mounting of said paper roll 6 onto roll holder 9A, 9B as described above, double printing and/or inferior image quality due to input error of paper type by operator can be prevented. Further, since paper used is automatically detected according to outer diameter of flanges 6*c*, more various types of paper can be handled by increasing the number of sensors. Further, since flange abutting member 17 is retracted when exchanging paper roll 6, flange abutting member 17 does not impede the exchange of paper roll 6.

Further, said detection unit 11 of the paper type is capable of automatically detecting the paper type from the position of the flange abutting member 17 abutting against said flange 6*c* merely by attaching a flange 6*c* to the paper roll 6, said flange having an outer diameter corresponding to the type of the roll paper 6*a*. Said detection unit 36 of the paper presence/absence is capable of automatically detecting the presence/absence of the roll paper 6*a* without contact. Said detection unit 41 of the paper leading end is capable of automatically detecting the leading end of the roll paper 6*a* subjected to printing to determine whether said leading end is properly positioned or not. Said control means 22 is capable of controlling the relevant portions such that a proper printing action onto the roll paper is assured on the basis of the detection result of the respective detection units 11, 36 and 41 and capable of automatically detecting the presence/absence of the roll paper to be positioned at the printing portion PP by means of the photosensors 37, regardless of whether the roll paper 6*a* is of light transmitting nature or not.

The relationship between the detection result by said respective detection units 11, 36 and 41 and the printing action of the control means 22 based on the detection result is shown in Table 3 below.

TABLE 3

| Detection Unit of Paper Type 11 | Detection Unit of Paper Presence/Absence 36 | Detection Unit of Paper Leading End 41 | Control Means 22 |
|---|---|---|---|
| Paper: Present Transparent | Light Reflection: Absent | Paper: Present | Printing Action: Suspended |
| Paper: Present Transparent | Light Transmission: Present | Paper: Present | Printing Action: Possible |
| Paper: Present Opaque | Light Reflection: Present | Paper: Present | printing Action: Possible |
| Paper: Present Opaque | Light Transmission: Absent | Paper: Present | Printing Action: Suspended |

Now, said detection unit 11 of paper type is adapted to output a signal indicating "paper absent" when the paper roll 6 is not loaded to the paper roll holding mechanism 8 while the control means 22 makes the printing action impossible.

Further, the roll paper 6*a* is formed of a transparent sheet which is light transmitting, with the trailing end of said transparent sheet 12 being formed with a light reflecting portion 12*a*. Therefore, it is possible to effectively use the entire surface of the roll paper 6*a* even if the roll sheet formed of the transparent sheet 12 of light transmitting nature is used. Moreover, the light reflecting portion 12*a* of the roll paper 6*a* makes it possible for the photosensors 37 in the detection unit 36 of paper presence/absence to automatically detect the trailing end of the roll paper 6*a*.

The present invention is not limited to the above described embodiments but can be modified if necessary.

As explained in the foregoing, the present invention is characterized in that the detection unit of paper type is capable of automatically detecting the paper type on the basis of the position of the flange abutting member which abuts against the flange merely if the flange having an outer diameter corresponding to the type of the roll paper is attached to the paper roll, that the detection unit of paper presence/absence is capable of automatically detect the presence/absence of the paper without contact thereto, that the detection unit of the paper leading end is capable of automatically detecting the paper leading end to determine whether said leading end is properly positioned, and that the control means is capable of controlling the relevant portions to perform the proper printing actions on the basis of the detection result of the respective detection units.

Further, the roll paper according to the present invention makes it possible to effectively use the entire surface of the roll paper when the roll paper formed of the transparent sheet of light transmitting nature is used and to automatically detect the trailing end of the roll paper in the detection unit of paper presence/absence by means of the light reflecting portions of the roll paper.

What is claimed is:

1. A device for printing paper from a pre-wound roll having an end flange of selectable diameter defining presence of a preselected characteristic in the paper, comprising:

a. a frame for holding the roll and defining a path for paper transport;

b. a table slidably movable along said frame;

c. means for contacting said flange and movably positioning said table respecting said frame according to the contacted diameter of said flange;

d. a plurality of light transmitting and blocking members fixedly connected to said table and moving along said frame unitarily with said table;

e. a plurality of light sensitive cells fixedly connected to said frame and being individually positioned to receive light through or be blocked from receiving light by said blocking members according to position of said table along said frame, each combination of the number of cells receiving light and the number of cells blocked from receiving light being correlated to a position of said table relative to said frame and hence to said preselected characteristic of said paper.

2. The device of claim 1 further comprising means for generating an electrical signal indicative of paper type on said roll from a collection of signals output by said cells responding to which individual ones of said cells are receiving light.

3. The device of claim 1 further comprising resilient means connected to said table for urging said contacting and positioning means into contact with said flange.

4. The device of claim 3 wherein said resilient means is connecting to said frame and urges said table to move relative to said frame.

5. The device of claim 4 wherein said resilient means acts transversely to the axis of the paper roll.

6. The device of claim 1 further comprising means for moving the flange contacting means into and out of contact with said roll flange responsively to be opening and closing of a device cover connected to said frame.

7. The device of claim 1 wherein said cells are of "U" shape and said light blocking members fit into the interior or the "U" shapes.

8. The device of claim 1 wherein the legs of said "U" shape are parallel with the direction of movement of said table.

9. The device of claim 1 wherein the U-shaped cells are below said table and said light blocking members are connected to a downwardly facing surface of said table.

10. The device of claim 9 wherein said transmitting and blocking members are planar.

11. The device of claim 10 wherein said transmitting and blocking members are perpendicular to said table.

12. The device of claim 9 wherein at least some of said transmitting and blocking members include apertures therein for transmission of light therethrough.

13. The device of claim 12 wherein said apertures are in the form of slits.

14. The device of claim 13 wherein said slits are arranged to allow different patterns of light to pass therethrough according to the position of said table as a function of the diameter of said roll flange thereby to affect different output signals produced by said cells corresponding to characteristics of said paper.

15. The device of claim 14 wherein signals from said cells are "ON" and "OFF" signals.

16. The device of claim 1 further comprising:

a. a platen roll rotatably connected to said frame and positioned fro passage of printing paper therearound after discharge from said paper roll;

b. means for optically sensing the presence of printing paper contacting said platen in position for printing thereon; and c. means for optically detecting a leading edge of said paper after paper passage over said platen.

17. A method for printing comprising:

a. placing a roll of paper into a printing device, with said roll having a flange of dimension corresponding to light transmission characteristics of said paper;

b. sensing said flange dimension to determine whether said paper is light transmissive;

c. providing a signal indicative of whether said paper is light transmissive to control means;

d. sensing light, if any, as reflected by said paper and transmitting a signal indicative thereof to said control means;

e. noting paper as being present for printing if said flange dimension determines said paper to be light transmissive and said signal indicates that light is sensed, or if said flange dimension determines said paper to light opaque and said signal indicates no light being sensed;

f. advancing said paper noted to be present and printing thereon;

g. cutting said portion of paper to which printing was applied from the remaining unprinted portion of the roll; and h. rewinding unprinted paper on to said roll sufficiently that the leading edge of the unwound unprinted paper is in position for printing thereon.

18. The method of claim 17 wherein said rewinding step further comprises rewinding unprinted paper on to said roll sufficiently that remaining unwound and unprinted paper is of size appropriate for a top or bottom margin on the next page to be printed.

19. Apparatus for printing paper from a pre-wound roll having an end flange of selectable diameter defining presence of an optical characteristic of the paper, comprising:

a. a frame for holding the roll and defining a path for paper transport;

b. a table slidably movable along said frame;

c. means for sensing said flange dimension to determine whether said paper is light transmissive, including:

i. means for contacting said flange and movably positioning said table respecting said frame according to the contacted diameter of said flange;

ii. a plurality of light transmitting and blocking members fixedly connected to said table and moving along said frame unitarily with said table;

iii. a plurality of light sensitive cells fixedly connected to said frame and being individually positioned to receive light through or be blocked from receiving light by said blocking members according to position of said table along said frame, each combination of the number of cells receiving light and the number of cells blocked from receiving light being correlated to a position of said table relative to said frame and hence whether said paper is light transmissive; and iv. means for sensing light, if any, as reflected by paper and transmitting a signal indicative thereof to said control means;

d. said control means noting paper as being present for printing if said flange dimension determines said paper to be light transmissive and said signal light opaque and said signal indicates no light being sensed;

e. means for advancing said paper noted to be present and printing thereon;

f. means for cutting said portion of paper to which printing was applied from the remaining unprinted portion of the roll; and g. means for rewinding unprinted paper on to said roll sufficiently that the leading edge of the unwound unprinted paper is in position for printing thereon.

* * * * *